US009700083B2

(12) United States Patent
DeCotiis

(10) Patent No.: US 9,700,083 B2
(45) Date of Patent: Jul. 11, 2017

(54) ALL OF ME STRAPLESS BRA

(71) Applicant: Carly DeCotiis, Watchung, NJ (US)

(72) Inventor: Carly DeCotiis, Watchung, NJ (US)

( * ) Notice: Subject to any disclaimer, the term of this patent is extended or adjusted under 35 U.S.C. 154(b) by 0 days.

(21) Appl. No.: 14/695,316

(22) Filed: Apr. 24, 2015

(65) Prior Publication Data

US 2016/0309796 A1 Oct. 27, 2016

(51) Int. Cl.

*A41C 3/00* (2006.01)
*A41C 3/06* (2006.01)
*A41F 1/00* (2006.01)

(52) U.S. Cl.

CPC ..... *A41C 3/06* (2013.01); *A41C 3/0028* (2013.01); *A41B 2300/32* (2013.01); *A41F 1/006* (2013.01)

(58) Field of Classification Search

CPC ..... A41C 3/06; A41C 3/0028
USPC .... 450/1, 78–80, 82, 84, 39, 88, 25, 23, 21, 450/34, 63, 76, 85; D2/708, 706
See application file for complete search history.

(56) References Cited

U.S. PATENT DOCUMENTS 1,765,003 A * 6/1930 Caldor ..... A41F 1/006 2/115
2,090,864 A * 8/1937 Grein ..... A41F 1/006 33/15
2,753,563 A * 7/1956 Blitch ..... A41C 3/00 450/62
2,940,454 A * 6/1960 Faron ..... A41C 3/00 450/67
2,970,597 A * 2/1961 Michel ..... A41C 3/02 24/442
4,300,568 A * 11/1981 Blanckmeister ..... A41F 1/006 450/85
4,325,378 A * 4/1982 Wilkinson ..... A41C 3/02 450/58
4,640,287 A 2/1987 Andreson et al.
4,700,406 A 10/1987 Meistrell
5,037,348 A 8/1991 Farino
6,123,601 A * 9/2000 Hildebrandt ..... A41F 1/006 24/306
6,319,091 B1 * 11/2001 Kilbride ..... A41C 3/0028 450/1
7,033,244 B1 * 4/2006 Barton ..... A41C 3/04 450/36
8,439,722 B2 * 5/2013 Buriak ..... A41C 3/0064 450/59
2006/0189254 A1 8/2006 Hood
2009/0075562 A1 * 3/2009 Lung ..... A41C 3/0071 450/58
2009/0186555 A1 * 7/2009 Fildan ..... A41F 1/006 450/77

(Continued)

FOREIGN PATENT DOCUMENTS

FR 1088947 A * 3/1955

*Primary Examiner* — Gloria Hale
*Assistant Examiner* — Brieanna Szafran

(57) ABSTRACT

An improved strapless bra having the capabilities of desired tightness that is resealable and reusable and not limited to set back closure hooks. The adjustable band replaces the typical hooks for fastening material of opposing pieces of fabric one with hook closure and one with loop closure that interlock when pressed together used to fasten bra. It enables users to adjust and fasten their band as tight as desired in order for it to stay secure and in its intended position to ensure support no matter what activity they are engaging in.

1 Claim, 3 Drawing Sheets

(56) References Cited

U.S. PATENT DOCUMENTS

| | | | | |
|---|---|---|---|---|
| 2012/0302137 | A1* | 11/2012 | Moylan ..... | A41C 3/0057<br>450/86 |
| 2013/0167284 | A1 | 7/2013 | Conner | |

* cited by examiner

ALL OF ME STRAPLESS BRA

CROSS REFERENCE TO RELATED APPLICATIONS

This application is a non-provisional utility patent application and claims the priority of design patent application, application Ser. No. 29/504,088, Group art unit 2913 filed in the United States Patent Office on Oct. 1, 2014 expressly incorporated herein by reference of its entirety.

BACKGROUND

The problem that All of Me strapless bra solves is providing a bra that enables the user to wear a strapless bra and adjust the tightness of the band depending on the size of rib cage/torso. Due to the adjustable band it can also serve as a way to elevate breasts.

Hood, US Patent 2006/0189254 A1 (2006) states "A typical strapless bra consists of a band with several clasps connected to one end of the torso strap with a like number of hooks or similar members on or near the end of the other torso strap to allow for fastening of the two torso straps. These clasps/hooks respectively allow the user to adjust the bra according to how tight the user would like the bra to be. This bra type does support the breast somewhat but is very restricting as it can not easily adjust to various body types especially in proximity to the torso." She then discusses that there is a need for a new and improved strapless bra " especially one that provides the requisite amount of support and allows for the fit to be adjustable to the users particular figure especially in proximity to the torso".

U.S. Pat. No. 5,037,348 Farino (1991) utilizes Velcro as a means of fastening the two torso straps. However, the fabric that creates the two torso straps are not made of flexible fabric that is easily maneuvered.

This product I came up with this idea over 3 years ago due to my own issues with wearing strapless bras. I could never wear one because I have large breasts and therefore would need a larger cup size which coincides with a bigger band around rib case/torso. The back band is always too big and never stays up regardless of any tape (that can be used on the skin) I utilized to keep it up because I have a small rib cag/torso. I therefore would never wear a strapless bra due to the lack of tension created to make me feel supported. I created a very simple prototype in 2011 using a bra that I had, I cut off the back band. I went to the store and purchased stretchable fabric and fastening tape (Velcro). I sewed the back band and attached the fastening tape. Then I came up with the idea of adding a strap along with the Velcro for extra support similar to a shin guard strap. Especially as a mental health professional I have seen the psychological impact on users who cannot buy certain tops/dresses/bathing suits which considerably limits clothing choices and impacts body image negatively.

SUMMARY

U.S. Pat. No. 4,700,406 Meisterell (1987) states, " insulative, flexible, relatively thin strap that is bi-directionally stretchable, the strap including a first elastrometic layer and a second layer of pile fabric attached to and substantially covering the outside of the first layer, the strap is adapted to be adjustably wrapped and tensioned . . . there are hook elements carried by the strap for removably attaching to the second layer at any position of wrap adjustment of the strap".

Both US Pat. No. 2013/0167284 A1, Conner (2013) and U.S. Pat. No. 4,640,287, Anderson et. al (1987) both utilize the concept of Velcro to provide fastening for two straps.

There are countless advantages of this product, which include the positive psychological aspect, adjustable to users figure, quick and easy attachment and removal, front and back support, lack of discomfort and desired tightness of band.

DRAWINGS

DETAILED DESCRIPTION

Figure 1:
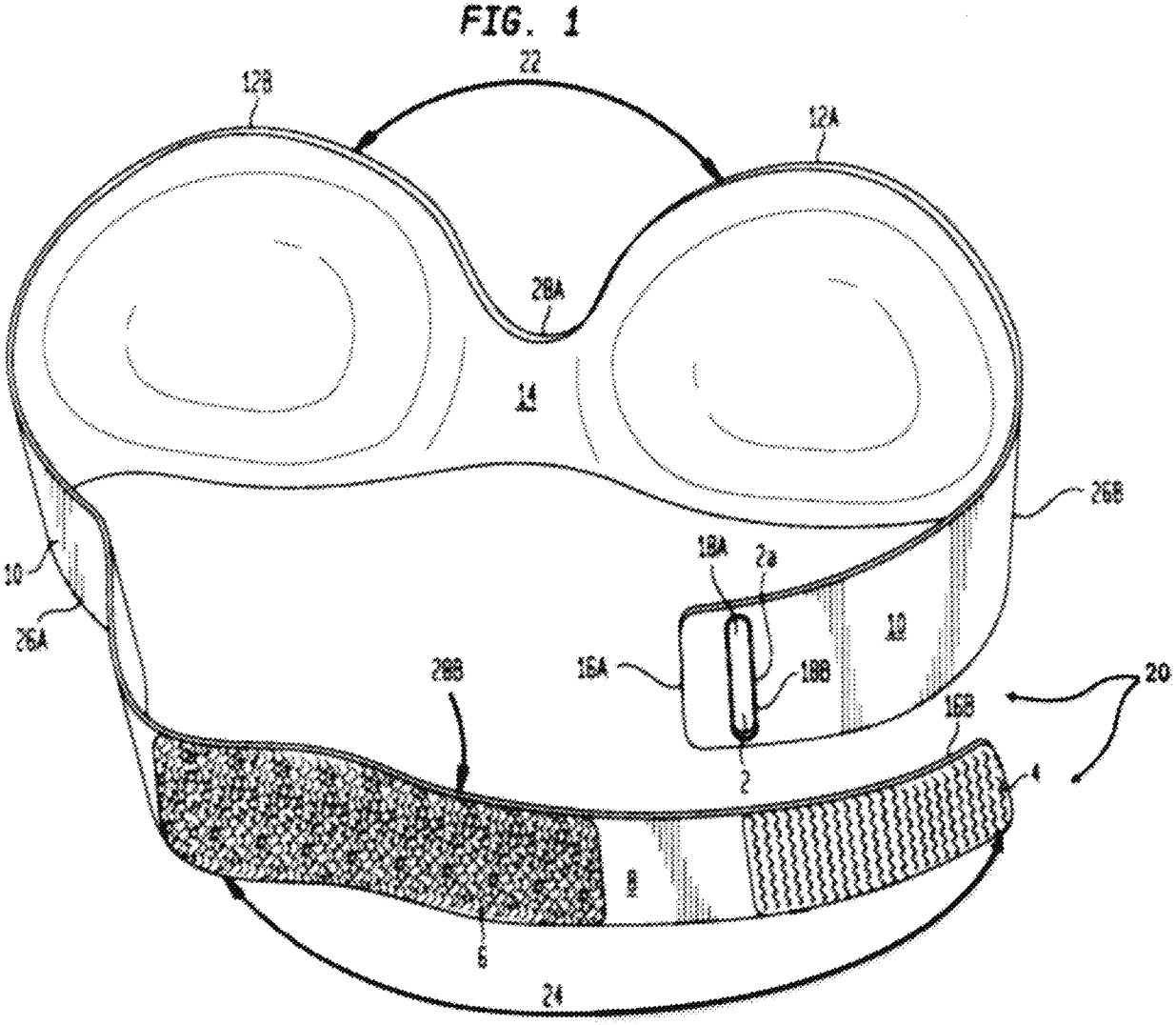
FIG. 1 is a rear view of the unassembled strapless bra.

FIG. 1 show the invention in detail. The device 10 consists of five primary components including an elongated elastic strap 8, loop material 6, hook material is 4, hook and loop closure made of a plastic molded outer section 2/2*a*, and stretchable and breathable fabric for chest encircling band 10. Device has a top surface, a bottom surface, and two end side surfaces extending perpendicularly between the top and bottom surfaces.

Figure 2:
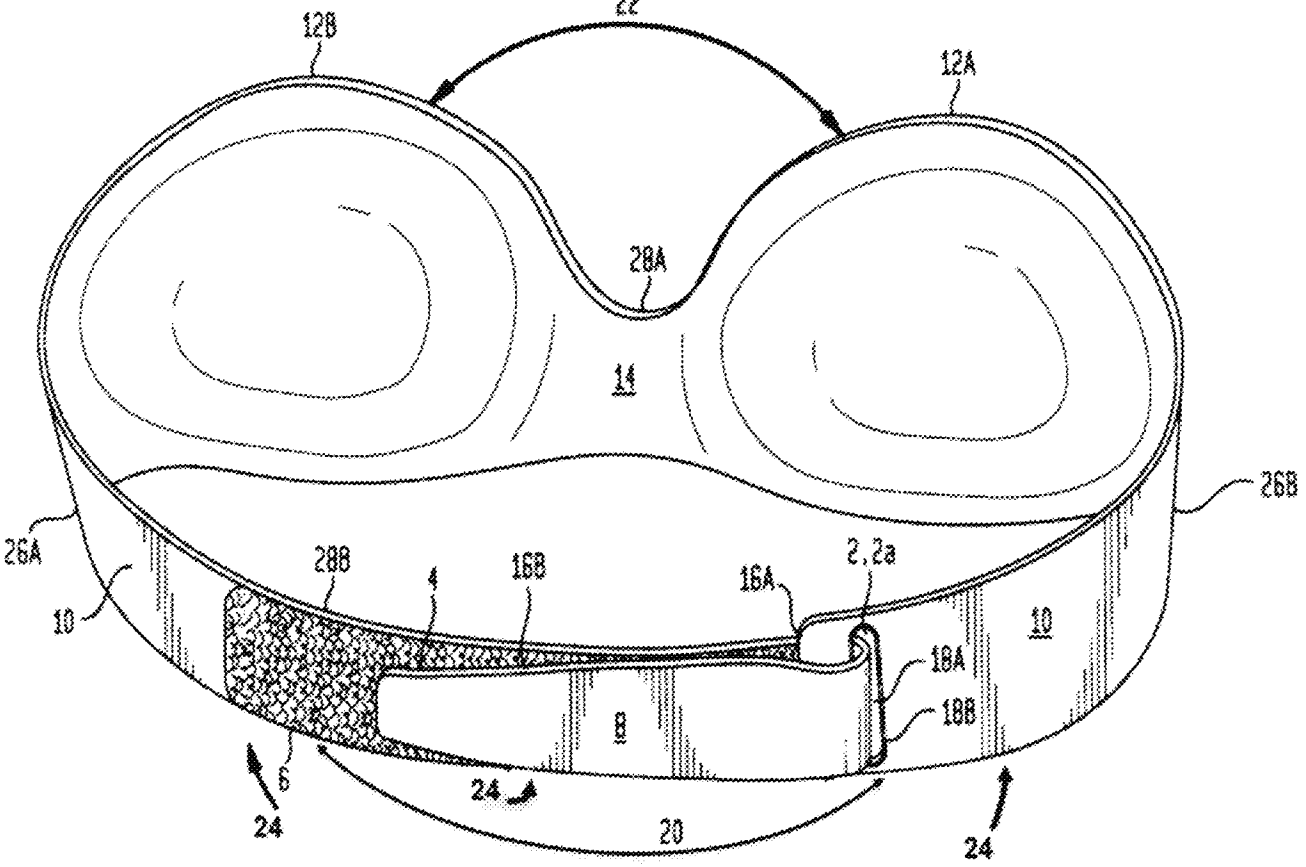
FIG. 2 is a rear view of the assembled and fastened strapless bra

FIG. 2 shows the details of the invention assembled and fastened. Elastic band 8 is pulled through hook and loop closure 2 to desired tightness, hook side 4, is then attached to loop side 6.

Figure 3:
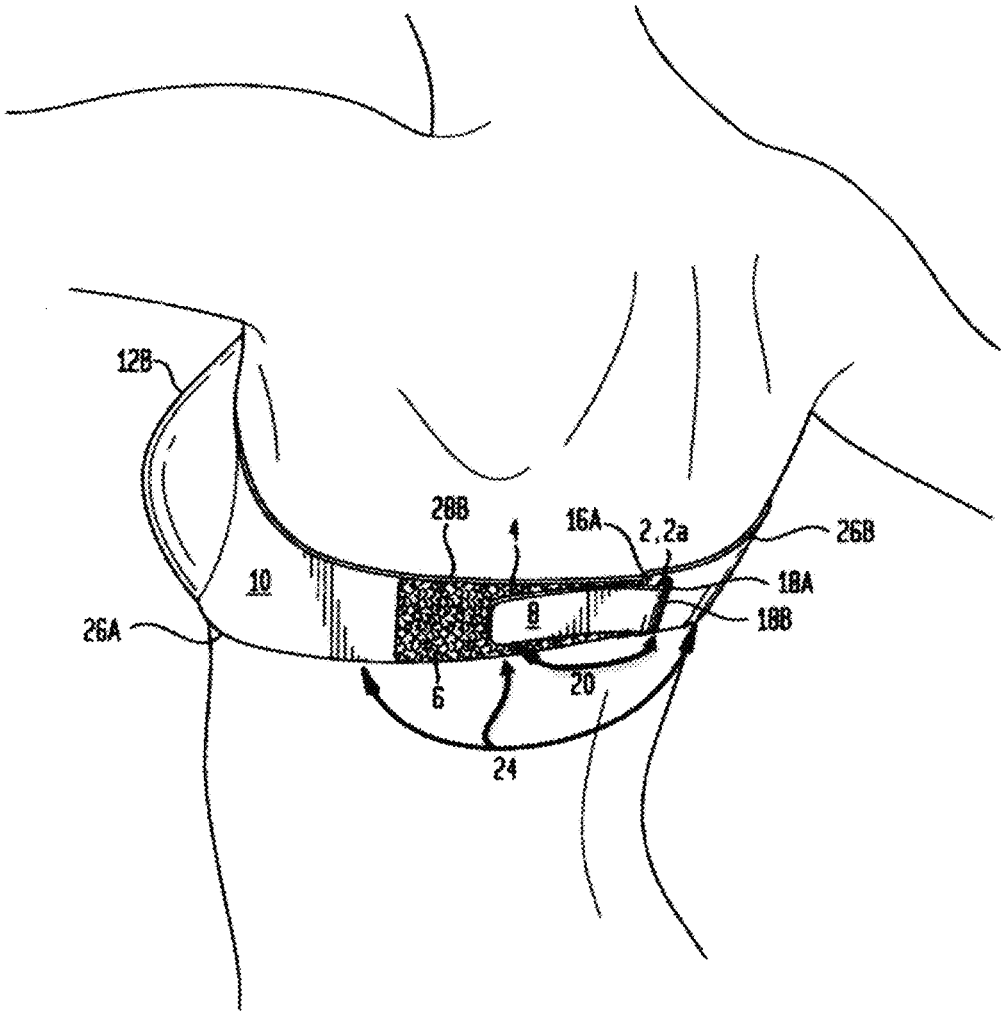
FIG. 3 is a rear view of the assembled and fastened strapless bra on a women's back.

FIG. 3 is a rear view of the assembled and fastened strapless bra on a user's back.

REFERENCE NUMERALS

2 aperture
2*a* is molded outer section of hook and loop closure
4 hook side of fastening material
6 loop side of fastening material
8 elongated elastic strap
10 stretchable and breathable fabric for chest encircling band
12*a* first cup
12*b* second cup
14 bridge portion
16*a* first band end
16*b* second band end
18*a* inner perimeter of molded outer section
18*b* outer perimeter of molded outer section
20 adjustable closure
22 top surface
24 bottom surface
26*a* first side surface
26*b* second side surface
28*a* front portion
28*b* back portion Operation In operation one uses the strapless bra band as a means of support for their breasts. 10. The user can, when desired adjust elongated elastic strap, there are several advantages to this:

(1) Elongated elastic strap, 8 can vary in tightness due to extensive length of loop side, 6
(2) Stretchable and breathable fabric band, 10 has the ability to conform to the shifting positions on the user's body (3) Elongated elastic strap, 8 can be used to uplift and support user's breasts (4) Elongated elastic strap, 8 due to various tightness can create cleavage for user if desired The adjustable band has two band ends 16*a*, 16*b*, which can be selectively fastened to each other via the adjustable closure 20. The first band end 16*a* of the two band ends 16*a*, 16*b* comprises a molded outer section 2*a* integral within the first band 16*a*. The molded outer section 2*a* has an inner and outer perimeter 18*a*, 18*b*. The outer perimeter 18*b* of the molded outer section 2*a* is surround by the first band 16*a*. The inner perimeter 18*a* is surrounded by the aperture 2 within the first band. The first band end 16*a* and the molded outer section 2*a* in the aperture 2 create the first part of the adjustable closure 20. The second band end 16*b* of the two band ends 16*a*, 16*b* comprises the elongated elastic strap 8 and hook and loop fastening material 4, 6 located on the one side of the adjustable band creating a first part of the adjustable closure 20. The hook and loop fastening material 4,6 located on one side of the second band end 16*b* is pulled through the molded outer section 2*a* residing within the aperture 2 of the first band end 16*a* so that the hook fastening material 4 is selectively attached to the loop fastening material portion 6 allowing the second band end 16*b* to be attached to itself.

The invention claimed is:

1. An adjustable strapless bra comprising:

a first cup, a second cup, and an adjustable band having an elongated elastic strap, wherein a bridge portion extends between and connects the first and the second cups to each other at a front portion of the adjustable strapless bra opposite a back portion of the adjustable strapless bra;

the back portion comprising a releasable, adjustable closure such that a wearer is adapted to adjust a tightness of the bra adaptively around a rib cage of the wearer;

the adjustable closure comprising the adjustable band with the elongated elastic strap, wherein the adjustable band has a first and second band end, each respectively extending from opposite sides of the first cup and the second cup, wherein the first band end extending integrally from the first cup comprises a molded outer section integral within the first band end, wherein the molded outer section comprises an inner and outer perimeter, wherein an entire said outer perimeter of the molded outer section is surrounded by the first band end and further wherein the inner perimeter is surrounded by an aperture located within the first band end, whereby the first band end with the molded outer section in the aperture creating a first part of the adjustable closure, further wherein the second band end extending integrally from the second cup comprises the elongated elastic strap and a hook and loop fastening material located on one side of the second band end creating a second part of the adjustable closure, the hook and loop fastening material comprising a loop fastening material portion separated from a hook fastening material portion on the one side of the second band end such that a portion of the second band end is pulled through the molded outer section residing within the aperture of the first band end so that the hook fastening material portion is selectively attached to the loop fastening material portion allowing the second band end to be attached to itself;

the adjustable strapless bra further comprising a top surface, a bottom surface, and two end side surfaces extending perpendicularly between the top and bottom surfaces, whereby the two end side surfaces being respective end portions of the first and second band ends.

* * * * *